US008764136B2

(12) United States Patent
Grabherr

(10) Patent No.: US 8,764,136 B2
(45) Date of Patent: Jul. 1, 2014

(54) COUPLING DEVICE FOR DETACHABLY CONNECTING A DRAWER TO A MOVEABLE RAIL

(75) Inventor: Simon Grabherr, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/457,777

(22) Filed: Apr. 27, 2012

(65) Prior Publication Data

US 2012/0217857 A1 Aug. 30, 2012

Related U.S. Application Data

(63) Continuation of application No. PCT/AT2010/000393, filed on Oct. 14, 2010.

(30) Foreign Application Priority Data

Nov. 27, 2009 (AT) ..... A 1890/2009

(51) Int. Cl.
*A47B 88/00* (2006.01)

(52) U.S. Cl.
USPC ..... 312/334.4; 312/334.6; 312/334.27

(58) Field of Classification Search
USPC ..... 312/334.4, 334.5, 334.6, 334.27; 384/22
See application file for complete search history.

(56) References Cited

U.S. PATENT DOCUMENTS 4,244,546 A * 1/1981 Mertes et al. ..... 248/258
4,250,540 A * 2/1981 Kristofek ..... 362/368
4,810,045 A * 3/1989 Lautenschlager ..... 312/334.5
5,257,861 A * 11/1993 Domenig et al. ..... 312/334.5
5,439,283 A * 8/1995 Schroder et al. ..... 312/334.4
5,580,139 A * 12/1996 Grabher ..... 312/333
5,588,729 A * 12/1996 Berger ..... 312/334.4
6,913,334 B2 * 7/2005 Weichelt ..... 312/334.4
6,986,558 B2 * 1/2006 Egger ..... 312/334.5
7,549,712 B2 * 6/2009 Booker et al. ..... 312/334.6

(Continued)

FOREIGN PATENT DOCUMENTS

AT 506 879 12/1979
AT 398 516 12/1994

(Continued)

OTHER PUBLICATIONS

Machine Translation of DE8228143.*

(Continued)

*Primary Examiner* — Janet M Wilkens
*Assistant Examiner* — Andrew Roersma
(74) *Attorney, Agent, or Firm* — Wenderoth, Lind & Ponack, L.L.P.

(57) ABSTRACT

The invention relates to a coupling device for detachably connecting a drawer to a movable rail of a drawer pull-out guide. The coupling device includes at least one movably mounted coupling part for detachably connecting the coupling device to the movable rail of the drawer pull-out guide. The coupling device includes an adapter device, so that the height position of the coupling part relative to the draw bottom can be adjusted. The adapter device includes a bearing part to be fastened to the drawer, and an adjustment part is connected to the coupling part. The adjustment part is adjustably supported in a direction substantially at a right angle to the drawer bottom in order to adjust the height position of the coupling part relative to the bearing part.

20 Claims, 6 Drawing Sheets

(56) References Cited

U.S. PATENT DOCUMENTS

| | | | | |
|---|---|---|---|---|
| 2008/0265729 | A1* | 10/2008 | Netzer et al. | 312/330.1 |
| 2009/0236959 | A1* | 9/2009 | Liang et al. | 312/334.4 |
| 2009/0251037 | A1* | 10/2009 | Berger | 312/334.1 |
| 2010/0194256 | A1* | 8/2010 | Grabherr | 312/319.1 |

FOREIGN PATENT DOCUMENTS

| | | | | |
|---|---|---|---|---|
| AT | 404 220 | | 9/1998 | |
| DE | 82 28 143 | | 1/1983 | |
| DE | 92 04 845 | | 6/1992 | |
| DE | 43 01 327 | | 8/1993 | |
| DE | 295 06 930 | | 8/1995 | |
| DE | 296 00 180 | | 2/1996 | |
| DE | 20 2007 006 549 | | 8/2007 | |
| EP | 0 421 458 | | 9/1993 | |
| EP | 0 695 523 | | 2/1996 | |
| EP | 732069 | A2 * | 9/1996 | A47B 88/00 |
| EP | 1 419 717 | | 5/2004 | |
| EP | 1457137 | A1 * | 9/2004 | A47B 88/04 |
| WO | WO 2009059338 | A1 * | 5/2009 | A47B 88/04 |

OTHER PUBLICATIONS

International Search Report issued Jan. 19, 2011 in International (PCT) Application No. PCT/AT2010/000393.

Austrian Patent Office Search Report completed Aug. 27, 2010 in Austrian Patent Application No. A 1890/2009.

* cited by examiner

COUPLING DEVICE FOR DETACHABLY CONNECTING A DRAWER TO A MOVEABLE RAIL

This application is a Continuation of International Application No. PCT/AT2010/000393, filed Oct. 14, 2010, the entire disclosure of which is incorporated herein by reference.

BACKGROUND OF THE INVENTION

The present invention concerns a coupling device for releasably connecting a drawer to a moveable rail of a drawer extension guide, wherein the coupling device is to be arranged in the region of the underside of the drawer bottom. The coupling device has at least one moveably mounted coupling portion for releasably connecting the coupling device to the moveable rail of the drawer extension guide.

The invention further concerns an arrangement having a drawer extension guide which is releasably connected by a coupling device of the kind to be described to a moveable rail of a drawer extension guide.

Coupling devices are known in the state of the art, by which a drawer can be fitted to and/or removed from a moveable rail of a drawer extension guide in its entirety. In that way, it is possible for the drawer—for example for cleaning purposes—to be completely released from the drawer extension guide and subsequently secured thereto again. In the mounting operation, the drawer extension guide is firstly premounted to the carcass of an article of furniture, whereupon in a subsequent mounting step, the drawer to be fastened is pushed onto the extension guide until finally the drawer is automatically latched to the extension rail which is in the closed position. Examples of such coupling devices are described in EP 0 421 458 B1 and DE 20 2007 006 549 U1 to the applicant. In that case, latching is effected by resilient latching portions whose displaced abutment surfaces can be successively latched in a recess in the rail, whereby when the drawer is pushed in gradual latching is implemented with a steady reduction in the play between the drawer and the extension guide, which however presupposes correct positioning of the coupling device relative to the moveable rail of the drawer extension guide.

In addition, coupling devices for releasably connecting the drawer to an extendable rail of a drawer extension guide are known, wherein the front portion of the drawer is displaceable in height in relation to the drawer rail by way of an adjusting mechanism, whereby the front panel of the drawer can be oriented for adjustment of the gap. Such structures are described for example in AT 398 516 B, DE 296 00 180 U1, DE 92 04 845 U1, AT 404 220 B, DE 295 06 930 and EP 1 419 717 A1.

SUMMARY OF THE INVENTION

The object of the present invention is to propose a coupling device of the general kind set forth in the opening part of this specification, wherein the heightwise position of the coupling device can be adjusted or compensated for relative to the drawer bottom, in particular when a bar projects downwardly from the drawer bottom.

According to the invention, the object is attained by the features described below. Further advantageous configurations of the invention are recited in the appendant claims.

According to the invention, the coupling device has an adapter device by which the heightwise position of the coupling portion relative to the drawer bottom is adjustable. The adapter device has a mounting portion which is to be fastened to the drawer, preferably to a bar projecting from the drawer bottom, and has an adjusting portion which is connected to the coupling portion and which is mounted adjustably for adjustment of the heightwise (vertical) position of the coupling portion relative to the mounting portion in a direction extending substantially at a right angle to the drawer bottom.

In other words, the adapter device provides that the heightwise position of the coupling device can be adjusted relative to drawer, whereby the position of the moveably mounted coupling portion can also be appropriately fixed relative to the drawer rail of the drawer extension guide.

Thus, the coupling device can be fastened by way of the adapter device to a side wall of the drawer—in particular, to a bar which in the mounted position of the drawer projects downwardly from the drawer bottom. The heightwise position of the coupling device can thus be altered relative to the drawer bottom by the adapter device. That gives the advantage that the coupling device is not fixedly connected to the front panel of the drawer so that possible adjustment of the position of the front panel relative to the drawer side wall is not impeded by the coupling device. The coupling device can thus be fastened by the adapter device to the downwardly projecting bar of the drawer side wall, so that it is possible to compensate for differing heights of the bar by the adapter device.

The adjustment travel of the adapter device can be effected steplessly or alternatively also by way of various predetermined latching positions. For stepless adjustment of the heightwise position of the coupling portion, the adapter device can have a self-locking transmission device which converts a rotary movement of an actuating portion adapted for hand adjustment or tool actuation, into a lowering or lifting movement of the coupling device. For that purpose, the adapter device can have, for example, a self-locking worm transmission, thereby permitting precise and continuous adjustment.

If in contrast adjustment by way of predetermined latching positions appears desirable, they can be implemented by way of a latching member cooperating by way of a resilient latching element or by way of a latching element acted upon by a spring. In an embodiment, the adapter device can permit a relative movement between the adjusting portion and the mounting portion in a direction, in which case the adjusting portion can be automatically latched relative to the mounting portion in various positions, and the adapter device locks a relative movement between the adjusting portion and the mounting portion in the opposite direction. That can be effected in a structurally simple fashion by the adjusting portion having a resilient tongue which is mounted displaceably along a tooth arrangement of the mounting portion. In that case, the tooth arrangement can be such that the adjusting portion is displaceable over tooth portions in one direction but in contrast the tooth portions block displacement of the tongue in the opposite direction.

The arrangement according to the invention includes a drawer extension guide and a drawer which is releasably connected by way of a coupling device of the described kind to a moveable rail of the drawer extension guide.

The article of furniture according to the invention includes an arrangement of the above-indicated kind.

BRIEF DESCRIPTION OF THE DRAWINGS

Further details and advantages of this invention are described by means of the specific description hereinafter. In the drawings.

DETAILED DESCRIPTION OF THE INVENTION

Figure 1:
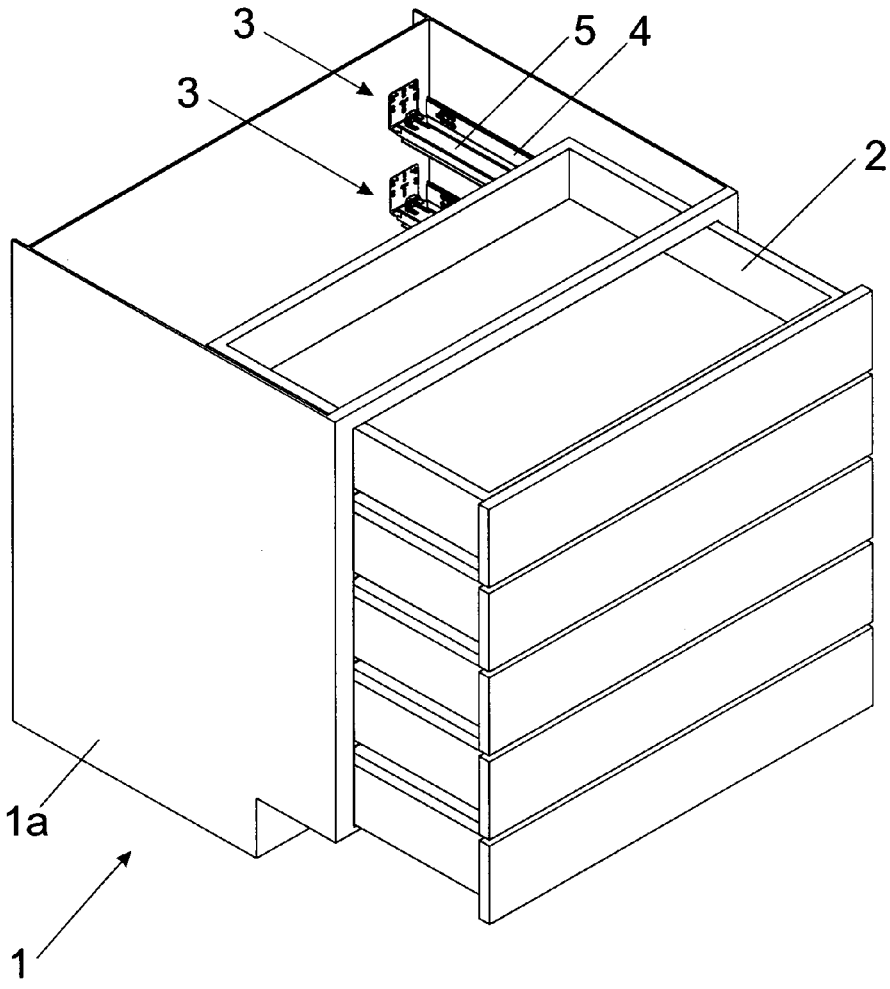
FIG. 1 is a perspective view of an article of furniture with displaceable drawers releasably connected by way of a coupling device to a moveable rail of a drawer extension guide.

FIG. 1 shows a perspective view of an article of furniture 1 in cabinet form, having a plurality of drawers 2 mounted displaceably relative to the carcass 1*a* of the article of furniture 1 by drawer extension guides 3. The drawer extension guide 3 includes a carcass rail 4 to be fastened to the carcass 1*a* of the article of furniture 1 and at least one moveable rail 5 which is displaceable relative to the carcass rail 4 and which is to be connected to the drawer 2 by way of a coupling device still to be described. Associated with each drawer 2 are respective drawer extension guides 3 which are pre-mounted at opposite side walls of the carcass 1*a*. The drawers 2 can be fitted and/or removed from the moveable rail 5 in their entirety without using a tool.

Figure 2:
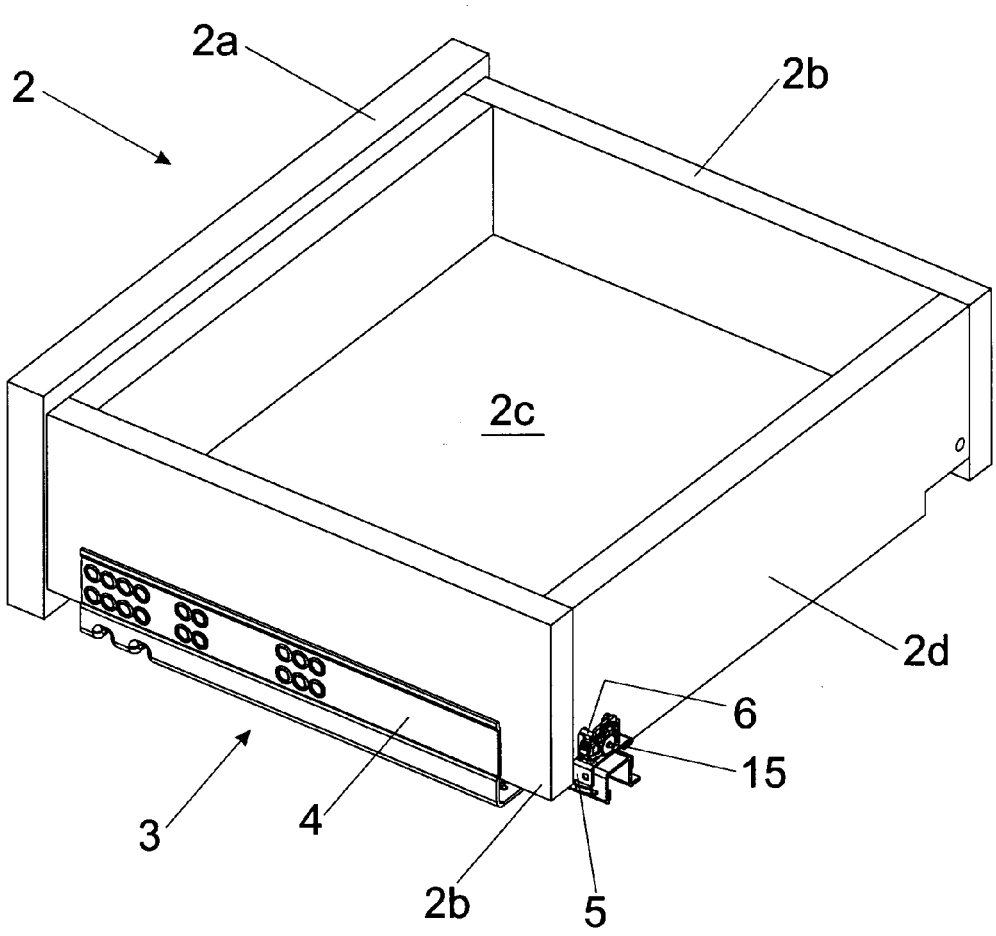
FIG. 2 is a perspective view of a drawer connected to a drawer extension guide.

FIG. 2 shows a perspective view of a drawer 2 coupled to the drawer extension guide 3. In a known manner, the drawer 2 includes a front panel 2*a*, side walls 2*b*, a drawer bottom 2*c* and a drawer rear wall 2*d*. It is possible to see the carcass rail 4 which is to be mounted in a stationary relationship to the carcass 1*a* and the moveable rail 5 which is moveable relative thereto. Arranged at the rear end of the extendable rail 5 is an abutment having a—preferably height-adjustable—pin 6 which in the mounted condition of the drawer 2 is disposed in an opening provided in the drawer rear wall 2*d*. The pin 6 can be adjusted in height by the adjusting wheel 15 so that in that way it is also possible to adjust the inclination of the drawer 2 relative to the rail 5 of the drawer extension guide 3 (and thus the front panel alignment). When mounting the drawer 2 in place, it is pushed on to the rail 5 which is in the closed position, until the pin 6 passes into the opening provided in the drawer rear wall 2*d* and thus defines the rear end abutment. The front region of the drawer 2 is coupled to the front end of the extendable rail 5 by the coupling device still to be described.

Figure 3:
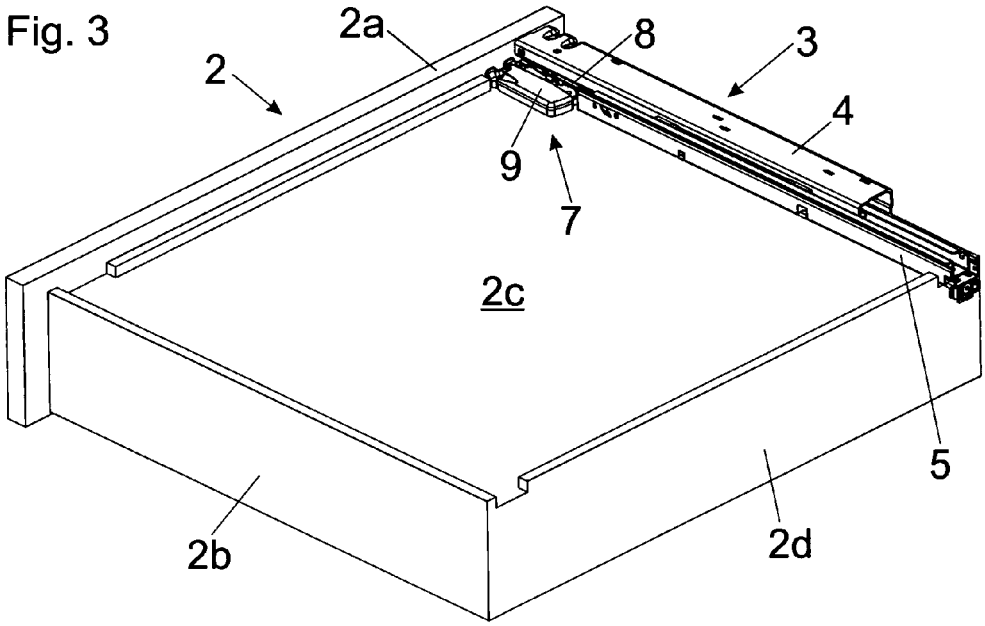
FIG. 3 is a perspective view from below of the drawer connected to the drawer extension guide.

FIG. 3 shows a perspective view from below of the drawer 2 connected to the extension guide 3. Arranged at the underside of the drawer bottom 2*c* in the region of the front panel 2*a* is a coupling device 7 by which the drawer 2 can be releasably connected and preferably can be releasably latched in its entirety to the moveable rail 5. The coupling device 7 includes a moveably mounted coupling portion 8 which in the mounted position engages at a latching edge or in a recess in the moveable rail 5. The coupling portion 8 is resilient so that in the mounting procedure the drawer 2 can be latched automatically with the moveable rail 5. To release the arresting action, there is a release portion 9 to be actuated manually in the form of a pivot lever, by which the moveable coupling portion 8 can be unlocked from the extension rail 5, whereby the drawer 2 can be completely removed from the drawer extension guide 3.

Figure 4:
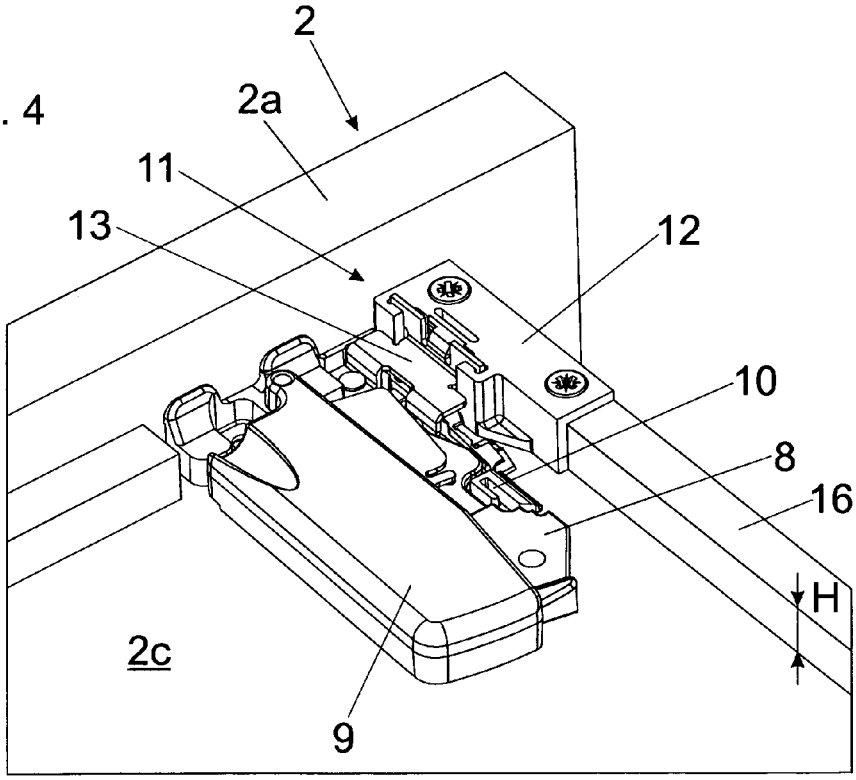
FIG. 4 shows a part of the drawer with the coupling device according to the invention.

FIG. 4 shows an enlarged detail view of the coupling device 7, the drawer extension guide 3 not being shown for the sake of clarity of the drawing. The coupling device 7 at the underside of the drawer bottom 2*c* has a—preferably slot-shaped—receiving member 10 which in the mounting position receives the front end of the moveable rail 5. Locking between the drawer 2 and the rail 5 is effected by the resilient coupling portion 8 which in the drawer mounting procedure automatically latches to the moveable rail 5. Unlocking is effected by the release portion 9, wherein the moveable coupling portion 8 is moveable into a release position by manually applying pressure to the release portion 9. The coupling device 7 has as an essential component an adapter device 11 by which the position of the moveably mounted coupling portion 8 is variably adjustable relative to the moveable rail 5 of the drawer extension guide 3 in a direction substantially perpendicular to the drawer bottom 2*c*. Thus, it is also possible to fix the heightwise position of the slot-shaped receiving member 10 and the moveable coupling portion 8 relative to the moveable rail 5. The adapter device 11 includes two portions which are displaceable relative to each other, namely a stationary mounting portion 12 to be fastened to the drawer 2 and an adjusting portion 13 which is adjustable relative to the mounting portion 12 and which is connected to the other components of the coupling device 7 (release portion 9, coupling portion 8, slot-shaped receiving means 10). Upon adjustment of the adjusting portion 13 relative to the stationary mounting portion 12, the other components of the coupling device 7 are also entrained. The mounting portion 12 has an angled configuration and is preferably mounted to a bar 16 projecting from the drawer bottom 2*c*. An advantage of the adapter device 11 is that different bar heights H can now be compensated thereby. As a further particularity, it is also to be stated that the coupling device 7 is only slidingly supported at the rear side of the front panel 2*a* or alternatively is mounted in spaced relationship with the front panel 2*a* (that is to say, it is not fixedly connected to the front panel 2*a*). In this way, height and/or inclination adjustment of the front panel 2*a* is possible without any problem.

Figure 5:
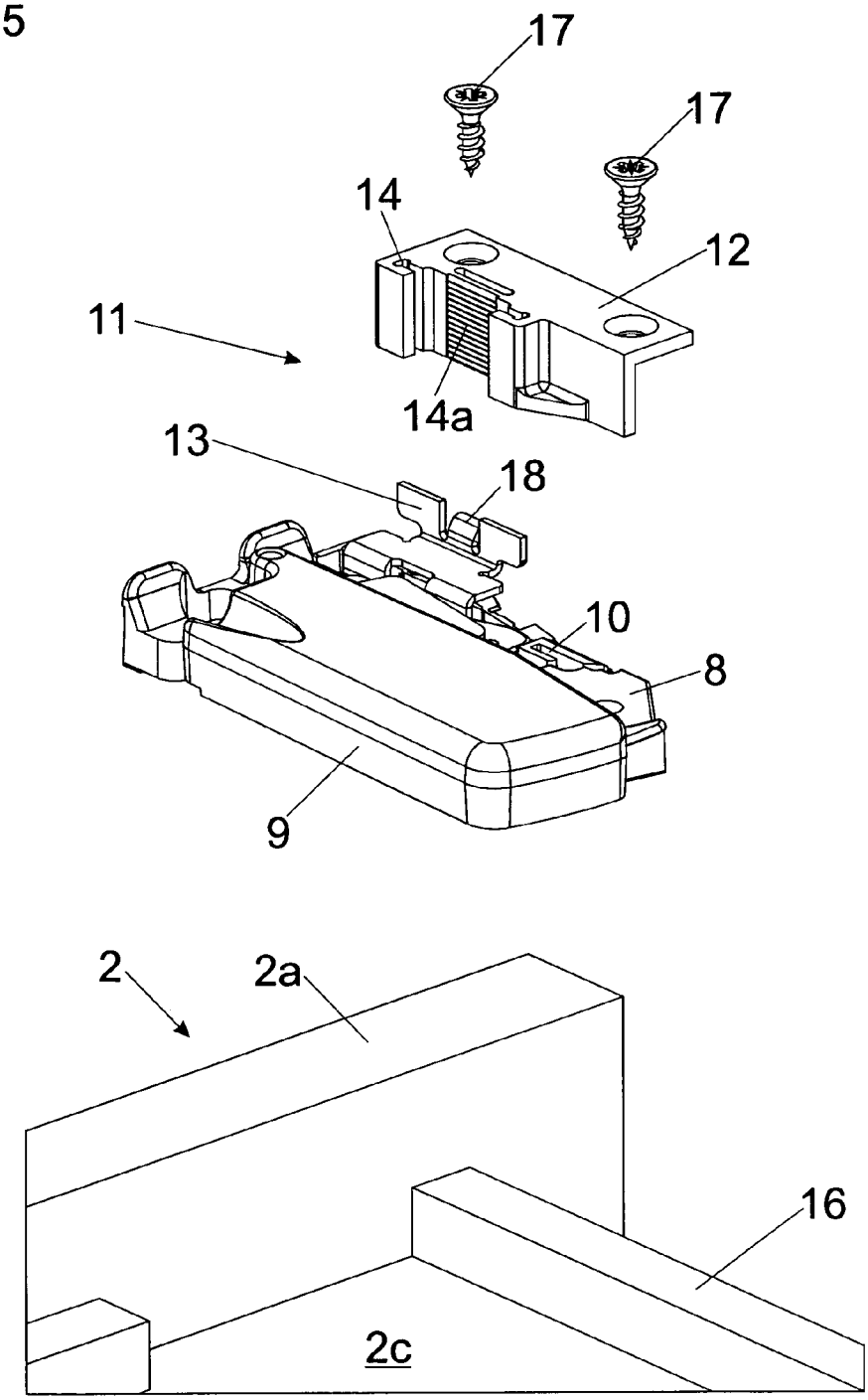
FIG. 5 is an exploded view of the coupling device.

FIG. 5 shows an exploded view of the two-part adapter device 11. The L-shaped mounting portion 12 can be fastened by screws 17 to the bar portion 16, which in the mounted position projects downwardly, of the side wall 2*b* (FIG. 3). The mounting portion 12 has a guide 14 for receiving and guiding the adjusting portion 13. The adjusting portion 13 is provided with a resilient tongue 18 which is latchable automatically along a tooth arrangement 14*a* of the mounting portion 12 at different latching positions. Adjustment of the resilient tongue 18 relative to the tooth arrangement 14*a* makes it possible to vertically adjust the slot-shaped receiving member 10 and the moveable coupling portion 8 in an appropriate position.

Figure 6A:
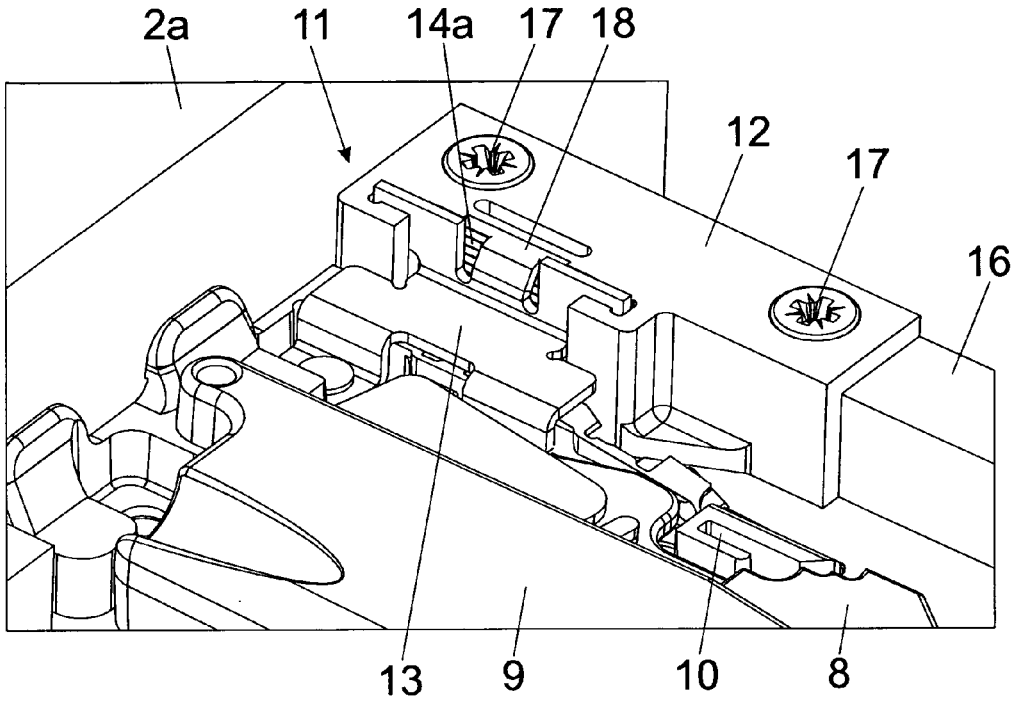
FIGS. 6*a*, 6*b* are various views of the coupling device in different heightwise positions.
Figure 6B:
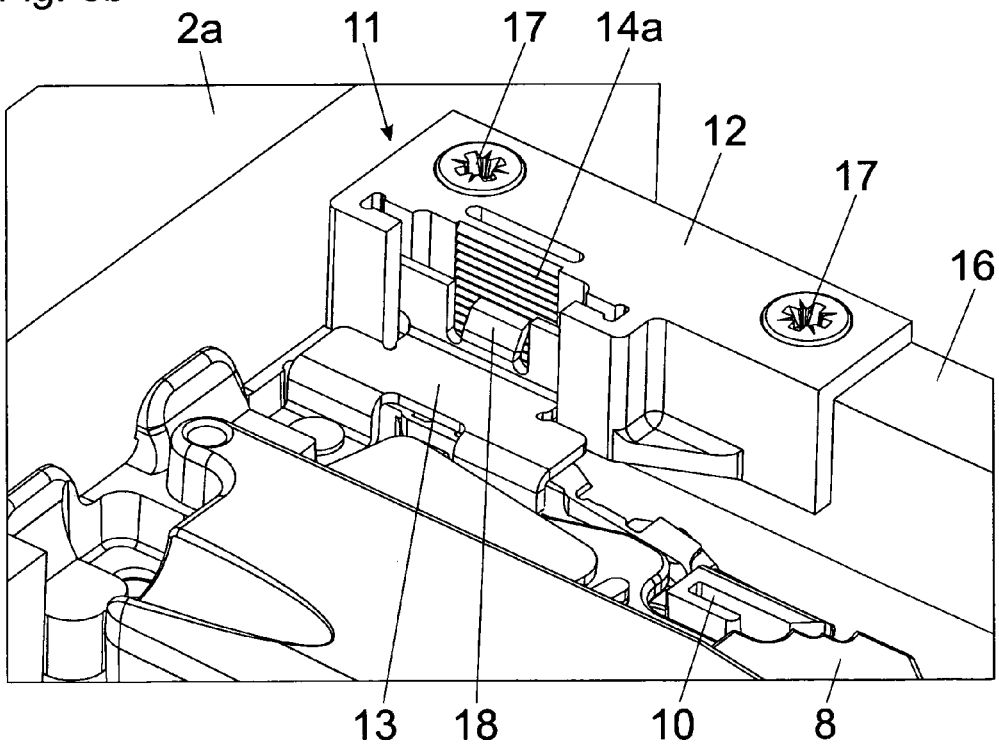

FIGS. 6*a* and 6*b* show detail views of the assembled coupling device 7 in different heightwise (vertical) positions which can fixed by the adapter device 11. The mounting portion 12 is mounted to the bar 16 of the drawer 2 by way of screws 17. The adjusting portion 13 has a resilient tongue 18 which is latchable along the tooth arrangement 14*a* of the mounting portion 12 in different heightwise (vertical) positions at predetermined locations. In other words, the tongue 18 can engage the tooth arrangement 14*a* at any of a plurality of positions. It will be appreciated that the adapter device 11 can also have a stepless adjusting device for setting the heightwise position of the coupling portion 8. FIG. 6*b* shows a position of the tongue 18, which is displaced in relation to FIG. 6*a*. It can be seen from FIGS. 6*a* and 6*b* that, due to the guide 14 holding the adjusting portion 13, the adjusting portion 13 can only be moved in the vertical (heightwise) direction perpendicular to the drawer bottom 2*c*, and not in a horizontal direction parallel to the drawer bottom 2*c*.

Figure 7:
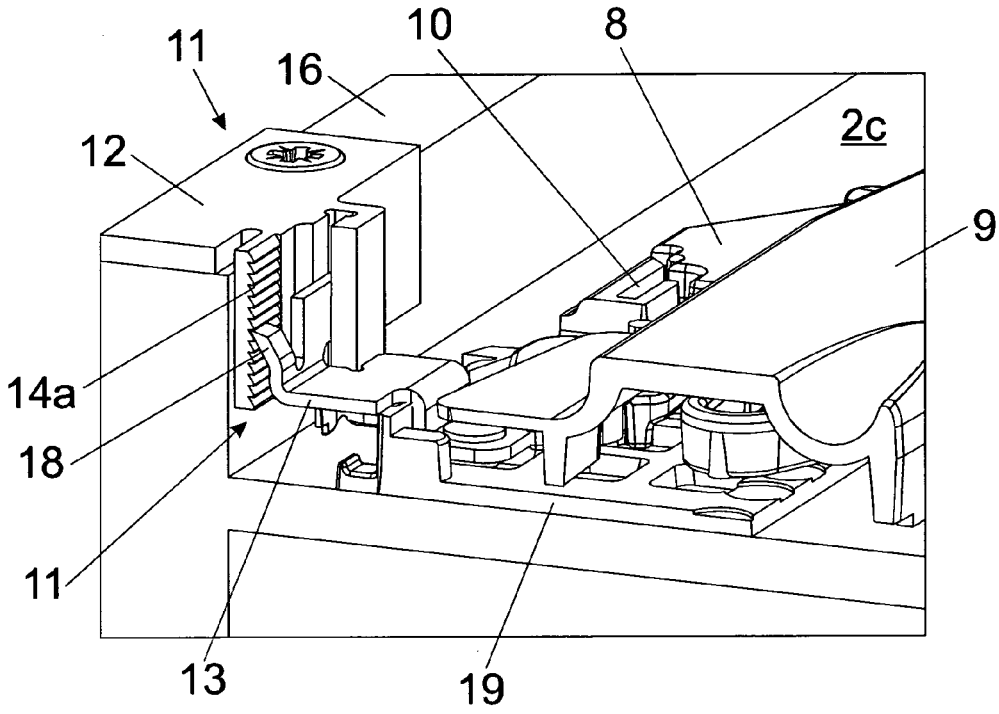
FIG. 7 is a further perspective view of the coupling device in the mounted condition.

FIG. 7 shows a further perspective view of the coupling device 7 in the mounted condition. It is possible to see the tongue 18 mounted displaceably relative to the tooth arrangement 14*a*. The tooth arrangement 14*a* is such that it permits displacement of the tongue 18 only in a direction towards the drawer bottom 2*c*, but prevents movement in the opposite direction (away from drawer bottom 2*c*). In general, when adjusting the adapter device 11, care is taken to ensure that the tongue 18 is displaced until a flat contact surface 19 of the coupling device 7 bears against the underside of the drawer bottom 2*c*. Subsequently, the drawer 2 can be pushed onto the moveable rail 5 of the drawer extension guide 3, in which case the moveable rail 5 urges the coupling portion 8 back and subsequently thereto can pass into the slot-shaped receiving member 10. When the moveable rail 5 is in the appropriate position within the receiving member 10, latching is implemented by the coupling portion 8. The coupling portion 8 can be moved into a release position again by manually applying pressure to the release portion 9 so that the drawer 2 can be completely released from the extension guide 3.

The adapter device 11 is therefore provided for compensating for the different heights H of the bar 16 so that the coupling device 7 can also be moved into abutment with the drawer bottom 2*c* because the moveable rail 5 (that is to say the drawer rail of the drawer extension guide) also bears against the underside of the drawer bottom 2*c* so that therefore appropriate latching of the coupling portion 8 to the moveable rail 5 is possible.

A further advantage of the invention is that the coupling device 7 is not fixedly screwed to the front panel 2*a* of the drawer 2 but to the lateral bar 16 of the drawer 2, whereby the position of the front panel 2*a* can be adjusted by the adjusting devices, which are usually provided, for the front panel (height/lateral/inclination), without that being impeded by a coupling device 7 screwed to the front panel.

Fitment to the lateral bar 16 is also substantially more comfortable as the screws 17 (FIG. 5) can be fitted and screwed in for fixing purposes at a right angle to the drawer bottom 2*c*. When mounting the coupling device 7 to the front panel 2*a* in contrast, the screws 17 have to be screwed in inclinedly relative to the rear side of the front panel 2*a*, whereby there is also a considerable risk that, when using inappropriate screws, the screws 17 penetrate through the front side of the front panel 2*a*, which in practice obviously is absolutely to be avoided.

Figure 8:
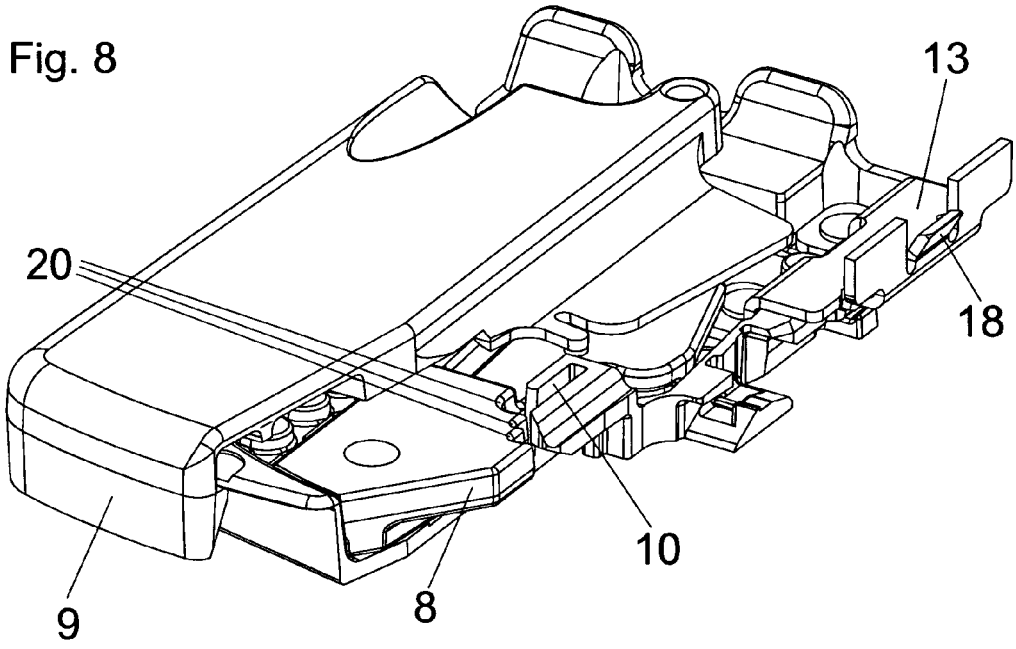
FIG. 8 shows the part of the coupling device, that is adjustable in height.

FIG. 8 shows a part of the coupling device 7 with the adjusting portion 13 and the resilient tongue 18. It is also possible to see the slot-shaped receiving member 10 for receiving a vertical limb of the moveable rail 5. The coupling portion 8 which is resilient or which is acted upon by a spring has a plurality of abutment surfaces 20 which are displaced in the extension direction of the drawer 2 and a respective one of which, in the mounted position, bears against a corresponding abutment of the moveable rail 5. The drawer 2 can be connected in substantially play-free relationship to the moveable rail 5 by the various abutment surfaces 20.

The present invention is not limited to the illustrated embodiments but includes or extends to all variants or technical equivalents which can fall within the scope of the claims appended hereto. The positional references adopted in the description such as for example up, down, lateral and so forth are also related to the usual position of installation of the coupling device 7 or to the directly described and illustrated Figure and are to be appropriately transferred to the new position upon a change in position.

The invention claimed is:

1. A coupling device comprising:

a moveably-mounted coupling portion for releasably connecting said coupling device to a moveable rail of a drawer extension guide; and an adapter device for adjusting a vertical position of said coupling portion relative to a bottom of a drawer, said adapter device including:

a mounting portion to be fixed to the drawer; and an adjusting portion connected to said coupling portion and configured to adjustably engage said mounting portion to adjust a position of said coupling portion relative to said mounting portion along an axis substantially perpendicular to the bottom of the drawer and in a direction towards the bottom of the drawer, and to prevent adjustment of the position of said coupling portion relative to said mounting portion in a direction away from the bottom of the drawer wherein said mounting portion has a tooth arrangement extending along said axis substantially perpendicular to the bottom of the drawer, and said adjusting portion has a tongue configured to engage any of a plurality of teeth of said tooth arrangement of said mounting portion so as to position said coupling portion at a desired vertical position relative to the bottom of the drawer, said teeth of said tooth arrangement and said tongue being configured to allow movement of said tongue along said tooth arrangement only in the direction towards the bottom of the drawer while preventing movement of said tongue in a direction away from the bottom of the drawer bottom.

2. The coupling device of claim 1, wherein said mounting portion has a plurality of latching positions, and said adjusting portion is configured to engage said mounting portion at any of said plurality of latching positions.

3. The coupling device of claim 1, wherein said mounting portion has a guide for holding said tongue of said adjusting portion in engagement with said tooth arrangement of said mounting portion.

4. The coupling device of claim 1, wherein said adjusting portion has a resilient tongue displaceable along a tooth arrangement of said mounting portion.

5. The coupling device of claim 1, wherein said coupling portion is resilient, and said coupling portion is configured to engage a recess of the moveable rail of the drawer extension guide in a mounting position.

6. The coupling device of claim 5, wherein said coupling portion has at least one abutment surface each configured to engage a latching edge of the moveable rail of the drawer extension guide.

7. The coupling device of claim 6, wherein said coupling portion has a plurality of abutment surfaces arranged in mutually displaced relationship along an extension direction of the drawer.

8. The coupling device of claim 1, wherein said coupling device is configured to be slidably mounted in a mounted position so as to be slidable relative to a front panel of the drawer.

9. The coupling device of claim 1, wherein said coupling device is configured to be mounted so as to be spaced apart from a front panel of the drawer.

10. The coupling device of claim 1, wherein said mounting portion has an L-shaped configuration.

11. An article of furniture comprising:

a drawer extension guide including a moveable rail;

a drawer including a bottom and a bar extending along said bottom and protruding downward from said bottom;

a coupling device for releasably coupling said drawer to said moveable rail, said coupling device including:

a moveably-mounted coupling portion releasably connecting said coupling device to said moveable rail of said drawer extension guide; and an adapter device for adjusting a vertical position of said coupling portion relative to said bottom of said drawer, said adapter device including:

a mounting portion fixed to said bar of said drawer; and an adjusting portion connected to said coupling portion and configured to adjustably engage said mounting portion to adjust a position of said coupling portion relative to said bar of said drawer along an axis substantially perpendicular to said bottom of said drawer and in a direction towards the bottom of the drawer, and to prevent adjustment of the position of said coupling portion relative to said mounting portion in a direction away from the bottom of the drawer wherein said mounting portion has a tooth arrangement extending along said axis substantially perpendicular to said bottom of said drawer, and said adjusting portion has a tongue configured to engage any of a plurality of teeth of said tooth arrangement of said mounting portion so as to position said coupling portion at a desired vertical position relative to said bottom of said drawer, said teeth of said tooth arrangement and said tongue being configured to allow movement of said tongue along said tooth arrangement only in the direction towards said bottom of said drawer while preventing movement of said tongue in a direction away from said bottom of said drawer bottom.

12. The article of furniture of claim 11, wherein said mounting portion has a plurality of latching positions, and said adjusting portion is configured to engage said mounting portion at any of said plurality of latching positions.

13. The article of furniture of claim 11, wherein said mounting portion has a guide for holding said tongue of said adjusting portion in engagement with said tooth arrangement of said mounting portion.

14. The article of furniture of claim 11, wherein said adjusting portion has a resilient tongue displaceable along a tooth arrangement of said mounting portion.

15. The article of furniture of claim 11, wherein said coupling portion is resilient, and said coupling portion is configured to engage a recess of said moveable rail of said drawer extension guide in a mounting position so as to releasably connect said coupling device to said moveable rail of said drawer extension guide.

16. The article of furniture of claim 15, wherein said coupling portion has at least one abutment surface each configured to engage a latching edge of said moveable rail of said drawer extension guide.

17. The article of furniture of claim 16, wherein said coupling portion has a plurality of abutment surfaces arranged in mutually displaced relationship along an extension direction of said drawer.

18. The article of furniture of claim 11, wherein said coupling device is slidably mounted to said bar of said drawer so as to be slidable relative to a front panel of said drawer.

19. The article of furniture of claim 11, wherein said coupling device is mounted to said bar at a location spaced apart from a front panel of said drawer.

20. The article of furniture of claim 11, wherein said mounting portion has an L-shaped configuration for allowing said mounting portion to be fitted to said bar.

* * * * *